United States Patent [19]

Schleffendorf

[11] Patent Number: 4,625,959

[45] Date of Patent: Dec. 2, 1986

[54] WEIGHT GUIDE FOR EXERCISING MACHINE

[76] Inventor: John J. Schleffendorf, 2312 Crescent Ave., Waukegan, Ill. 60085

[21] Appl. No.: 610,867

[22] Filed: May 16, 1984

Related U.S. Application Data

[63] Continuation-in-part of Ser. No. 356,635, Mar. 10, 1982, Pat. No. 4,515,363.

[51] Int. Cl.[4] ..... A63B 21/06

[52] U.S. Cl. ..... 272/118; 272/134

[58] Field of Search ..... 272/117, 118, 134, 136, 272/116

[56] References Cited

U.S. PATENT DOCUMENTS

| | | | |
|---|---|---|---|
| 499,205 | 6/1893 | Bryon, Jr. | 272/118 |
| 723,625 | 3/1903 | Thornley | 272/118 |
| 3,627,315 | 12/1971 | Marcyan | 272/118 |
| 3,820,782 | 6/1974 | Salkeld | 272/134 X |
| 3,840,227 | 10/1974 | Chesemore | 272/118 |
| 4,311,305 | 1/1982 | Lambert, Jr. et al. | 272/118 |
| 4,470,596 | 9/1984 | Desiderio | 272/118 |
| 4,515,363 | 5/1985 | Schleffendorf | 272/118 |

*Primary Examiner*—Richard J. Apley
*Assistant Examiner*—John L. Welsh
*Attorney, Agent, or Firm*—Hill, Van Santen, Steadman & Simpson

[57] ABSTRACT

A weight guide for an exercising machine includes a base with a hollow vertical column having elongated vertical slots, a plurality of weights embracing the hollow column and each having a horizontal aperture, a plug having horizontal apertures being movable within the hollow column, a cable having one end extending down in the hollow column and being connected to the plug and an arrangement for connecting a selected one of the weights to the plug by a connector extending through aligned apertures of the plug and selected weight and through one of the vertical slots in the column.

16 Claims, 8 Drawing Figures

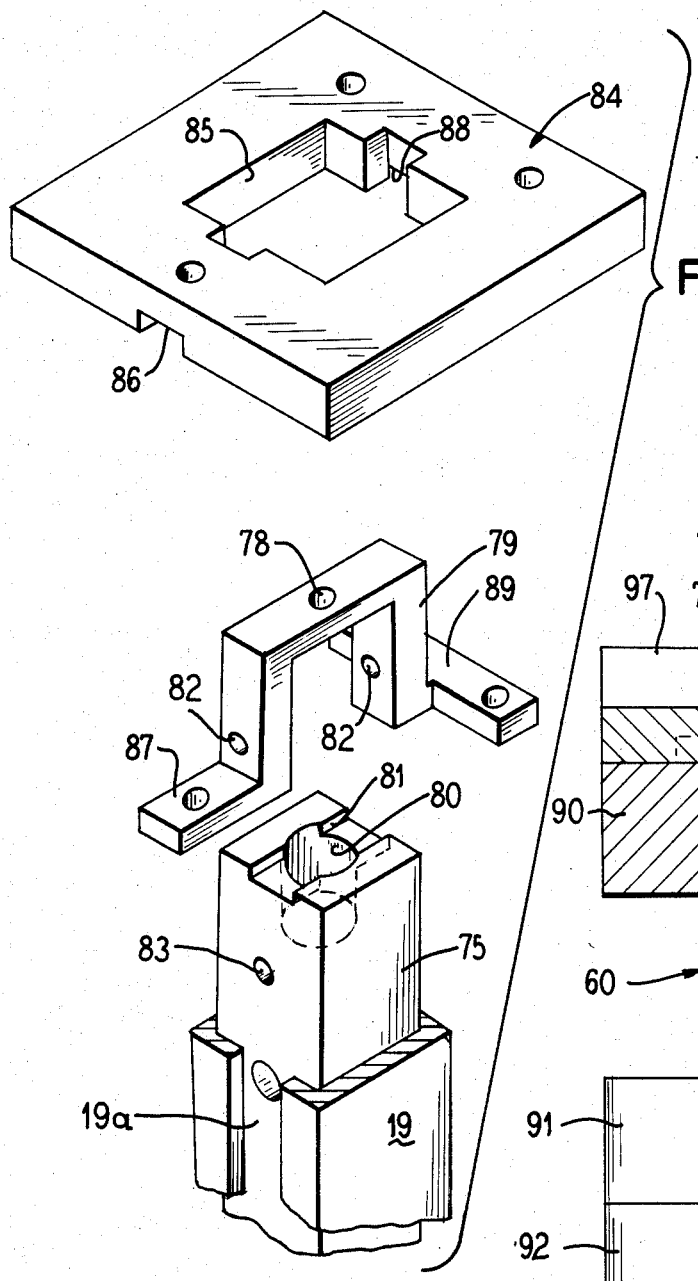
FIG. 8
FIG. 7
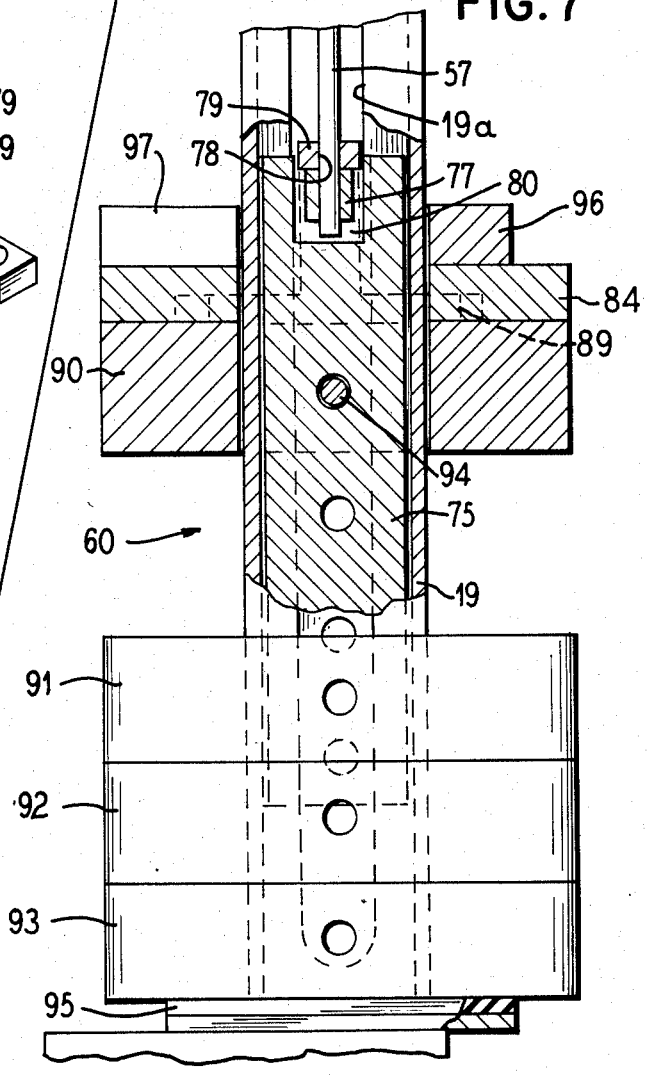

WEIGHT GUIDE FOR EXERCISING MACHINE

RELATED APPLICATION

This application is a continuation-in-part of my copending application, Ser. No. 356,635, which is now patent No. 4,515,363 filed Mar. 10, 1982 on an "EXERCISING MACHINE".

BACKGROUND OF THE INVENTION

1. Field of the Invention

This invention relates to physical exercise apparatus for use in developing human muscles, and in particular to a weight guide for use in such apparatus.

2. Prior Art

The human body has a substantial number of muscle groups and in the past various types of mechanical exercise equipment have been used to increase both muscular strength and size. Some of these have involved the use of weights, and such usage would normally entail some form of guidance structure for such weights. However, there are certain disadvantages in some of the systems that have been used in the past.

One such structure has utilized a pair of vertical rods with a pulley-guided cable therebetween, the cable leading to an uppermost plate or weight, the plate having a pair of bronze bushings receptive of the vertical rods. Normally such rods are plated and are oiled, thereby producing resulting dirty oily rod surfaces.

Another structure has utilized a pair of vertical rods which have confronting channels facing toward each other. In this structure, individual weights have bearing material which engages the outer surfaces of the channels. Thus every weight needs a pair of bearing surfaces. With this arrangement there tends to be wear and tear on the vertical channels resulting in a sticky movement.

SUMMARY OF THE INVENTION

A physical exercising machine according to the invention includes a weight guide which has a number of weights that act through a cable, the cable being adapted to be connected to exercising apparatus for tensioning and releasing such cable. In this instance, the cable is directed downwardly into a hollow vertical column to an elongated plug that is guided within the column and which has means extending through vertical slots in the vertical column for supporting individual weights thereon in spaced relation to the outer surface of the column. Thus with this arrangement, there is no external surface that would need lubrication, and there are no friction residues that would heretofore soil a floor or carpet. Thus with the present invention, a structure is provided which cuts the operating noise and eliminates grease or oil, which facilitates an easy cable change, which provides frame rigidity, and a pleasant appearance.

Accordingly, it is an object of the present invention to provide a weight guide for an exercising machine which requires no lubrication and which is relatively noise-free.

Another object of the present invention is to provide an exercising machine fitted with such novel weight guide.

Many other advantages, features and additional objects of the present invention will become manifest to those versed in the art upon making reference to the detailed description and the accompanying sheets of drawings in which preferred structural embodiments incorporatng the principles of the present invention are shown by way of illustrative example.

BRIEF DESCRIPTION OF THE DRAWINGS

FIG. 7 is a vertical view, partly in cross-section, of a second embodiment of weight guide provided in accordance with the present invention; and FIG. 8 is a perspective view of certain parts of FIG. 7 shown in exploded fashion.

AS SHOWN IN THE DRAWINGS

Figure 1:
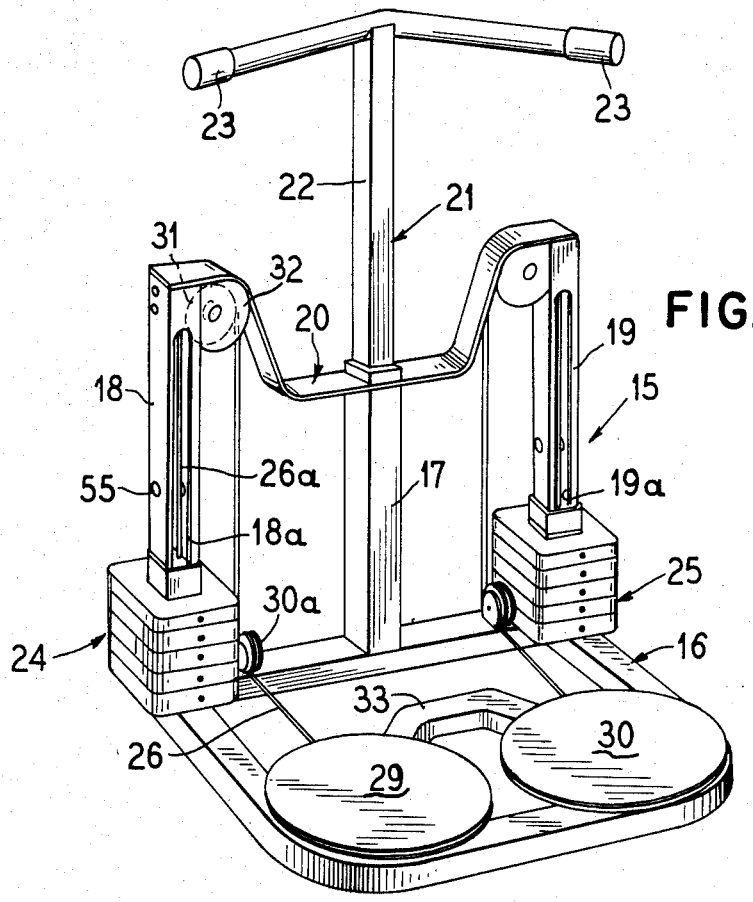
FIG. 1 is a perspective view of a physical exercising machine provided in accordance with the present invention.
Figure 2:
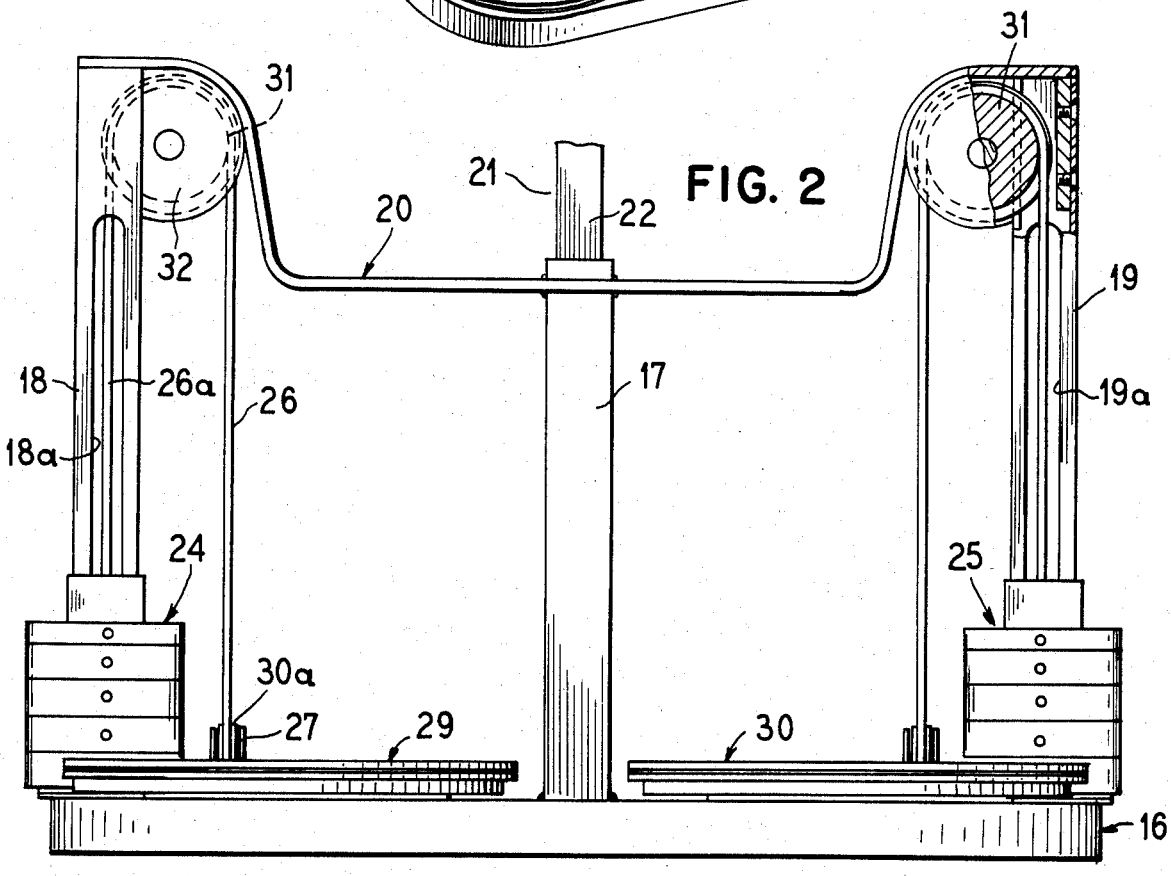
FIG. 2 is an enlarged front elevational view of FIG. 1, with parts removed.

A physical exercising machine according to the invention is shown in FIG. 1, generally indicated by the numeral 15. The machine 15 includes a base 16 to which is secured a vertical standard 17, and a pair of hollow vertical columns 18, 19, the columns respectively having slots 18*a* and 19*a* on both the front and rear sides. The upper ends of the standard 17 and the columns 18, 19 are joined together by a primarily horizontal strap 20. The vertical standard 17 supports a transmitting means 21, here comprising a post 22 and a pair of hand grips 22, 23. The transmitting means 21 is disclosed and explained more fully in the parent application identified above which is incorporated herein by reference.

The exercising machine 15 further includes a pair of rotatably carried support tables 29, 30 both also disclosed more fully in the parent application identified above.

The base 16 comprises hollow tubing of square cross-section which extends along the rear of the machine, along both sides and across the front, and further includes another tubular portion 33 which extends toward the center from the front corners to form an obtuse angle.

The support tables 29, 30 are respectively adapted to support a human foot on each one, and each support table 29, 30 is movable from the neutral position illustrated, in either angular direction against a force provided by a pair of resistance means 24, 25, while the transmitting means 21 can be gripped to provide a reactive force in the human body. The resistance means 24, 25 are identical to each other except that one is in part a mirror image of the other. Therefore, for convenience, the description which follows entails the vertical column 18 and the resistance means 24.

Each resistance means 24, 25 includes a cable 26 which extends horizontally from the support table 29 and then is directed upwardly about a first pulley 30*a* from the horizontal to the vertical, and extends about a second pulley 31 which directs a portion 26*a* of the cable downwardly within the hollow vertical column 18 wherein the end thereof is secured to a system of weights. The end of the cable 26 that is secured to the support table 29 may be secured to any other exercising machine means for imparting a tension to such cable 26.

The first pulley 30*a* is supported in a mounting bracket 27 which has a pivotal connection with the base 16 whereby the pulley 30*a* is self-aligning with the cable 26 as the table 29 is rotated from the neutral position, or returned to the neutral position. The pulley 31 is rotatably supported on a pair of bearing and guard plates 32 secured to the strap 20 and the column 18.

Figure 3:
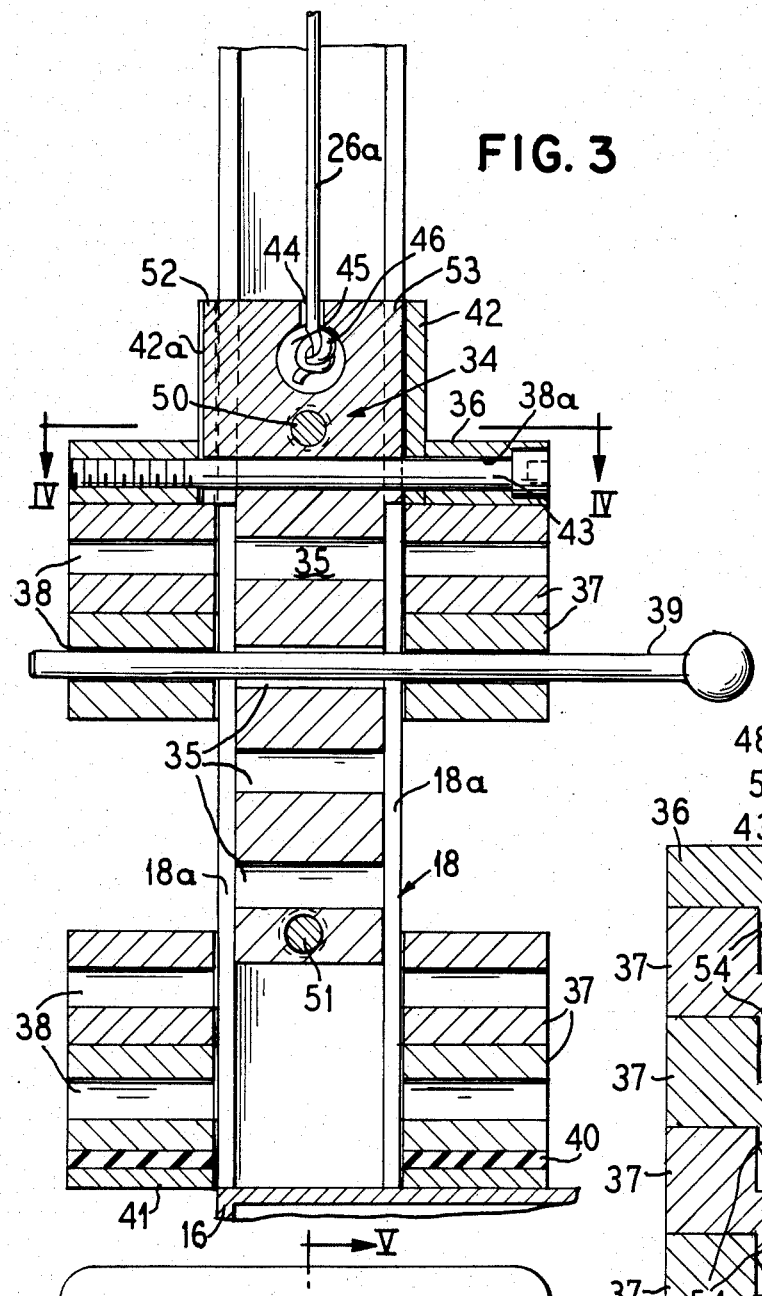
FIG. 3 is an enlarged vertical cross-sectional view taken along line III—III of FIG. 4, showing a weight guide which is embodied in the machine of FIGS. 1 and 2.
Figure 5:
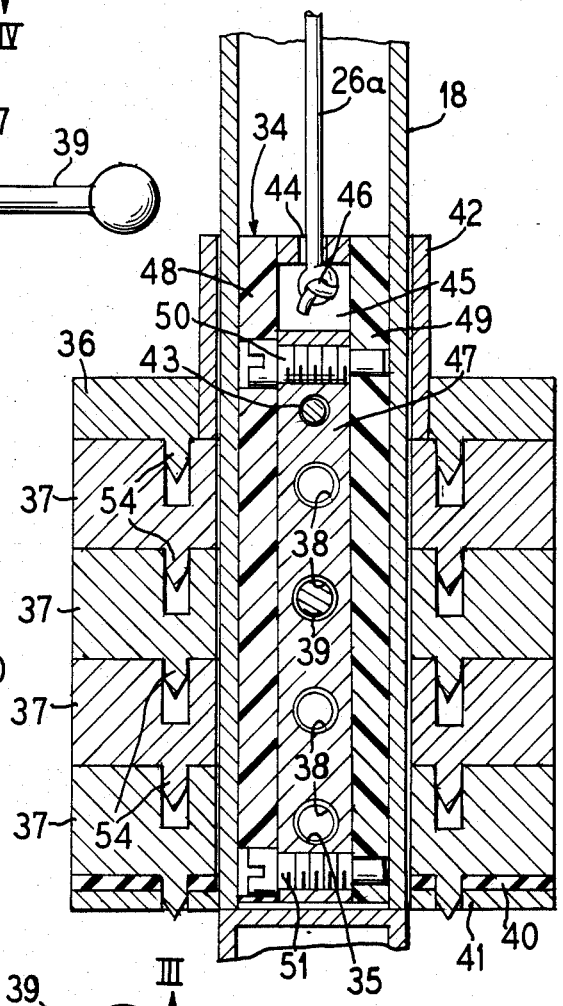
FIG. 5 is a vertical cross-sectional view taken along line V—V of FIG. 4.
Figure 4:
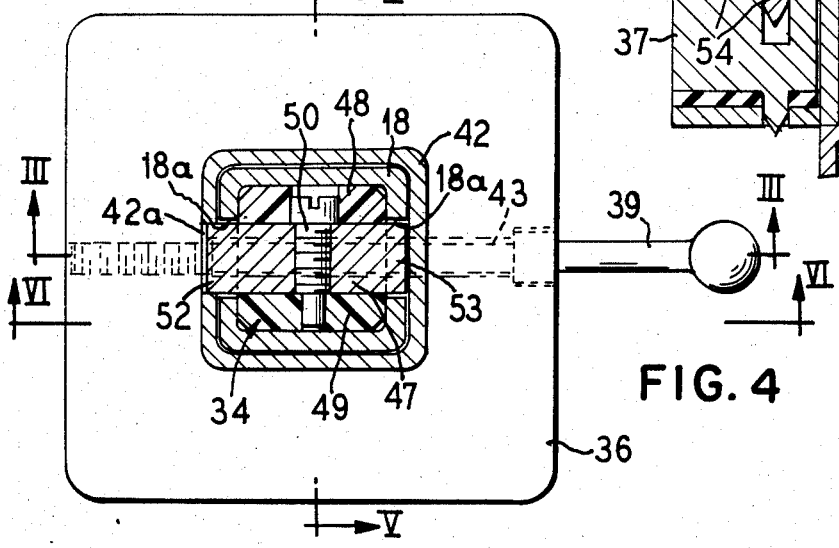
FIG. 4 is a cross-sectional view taken along line IV—IV of FIG. 3.

The weight system or weight guide 24 is disposed partially within the hollow vertical column 18 and partially on the outside thereof. FIGS. 3, 4, and 5 illustrate this relationship. Within each hollow column 18, 19, there is an elongated plug 34, shown here to have four horizontal apertures 35. The mass of the plug 34 is one component of the weight means. Other components include an uppermost weight 36 and four additional individual weights 37 each of which is generally annular in configuration as shown from above in FIG. 4 and which has an aperture 38 or 38*a* extending across its central opening. In the neutral or "at rest" position, the weights 36, 37 make a vertical stack as shown in FIG. 5. And under this condition, the apertures 38 are in registration with the apertures 35. Under this condition, a connector or connector pin 39 may be manually inserted into aligned apertures which also register with the vertical slots 18*a* of the vertical column 18. Thus when an upward force is applied to the cable 26, the weight 37 through which the connector pin 39 extends is coupled with the plug 34 and is hence lifted, together with the weights lying thereabove. The lowermost weight 37 is underlaid by a cushion 40 which has a backup plate 41 secured to the base 16.

The uppermost weight 36 is provided with a tubular guide 42 which is rigidly secured thereto, the tubular guide 42 being slotted as at 42*a* in one wall thereof as shown in FIG. 4. The uppermost weight 36, the tubular guide 42 and the plug 34 have aligned apertures which jointly receive a screw 43 which also extends through the slots 18*a* of the column 18. The plug 34 has a vertical aperture 44 which intersects a transverse aperture 45, thereby providing a cavity for a knot 46 on the end of the cable 26*a*.

As best seen in FIG. 5, the plug 34 comprises an apertured metal central portion 47 and a pair of elongated rigid plastic portions 48, 49 secured to the central metal portion 47 by a pair of upper and lower screws 50, 51. As shown in FIG. 4, the central portion 47 of the plug 34 has at its upper end a pair of vertical bosses 52, 53 through which the screw 43 passes, the bosses 52, 53 extending through the slots 18*a*, the bosses 52, 53 being centered within the slots 18*a*, 18*a* by the elongated rigid plastic portions 48, 49. The boss 53 on the central portion 47 extends horizontally through the slot 18*a* to the interior of the tubular guide 42 with which the bosses are comovable, while the boss 52 extends horizontally snugly into the slot 42*a* whereby the tubular guide 42 is centered indirectly by the elongated rigid plastic portions 48, 49 acting through the central metal portion 47 of the plug 34. Each of the screws 50, 51 has a threaded intermediate portion which engages threads in the central portion 47 of the plug 34, and each of the screws 50, 51 has cylindrical portions at its opposite ends which are received in correspondingly sized apertures in the elongated rigid plastic portions 48, 49.

Thus the metal parts within the vertical column 18 and the metal parts surrounding the vertical column 18 are radially spaced therefrom while the sole components that engage any portion of the vertical column 18 are the pair of elongated rigid plastic portions 48, 49 of the plug 34. In order to maintain this spacing, both when weights 37 are raised as shown for the two upper weights 37 in FIG. 3, and when the weights 37 are at rest, aligning means in the form of centering pins 54 and guide holes in register therewith are provided for each of the weights that are outside of the column 18.

Figure 6:
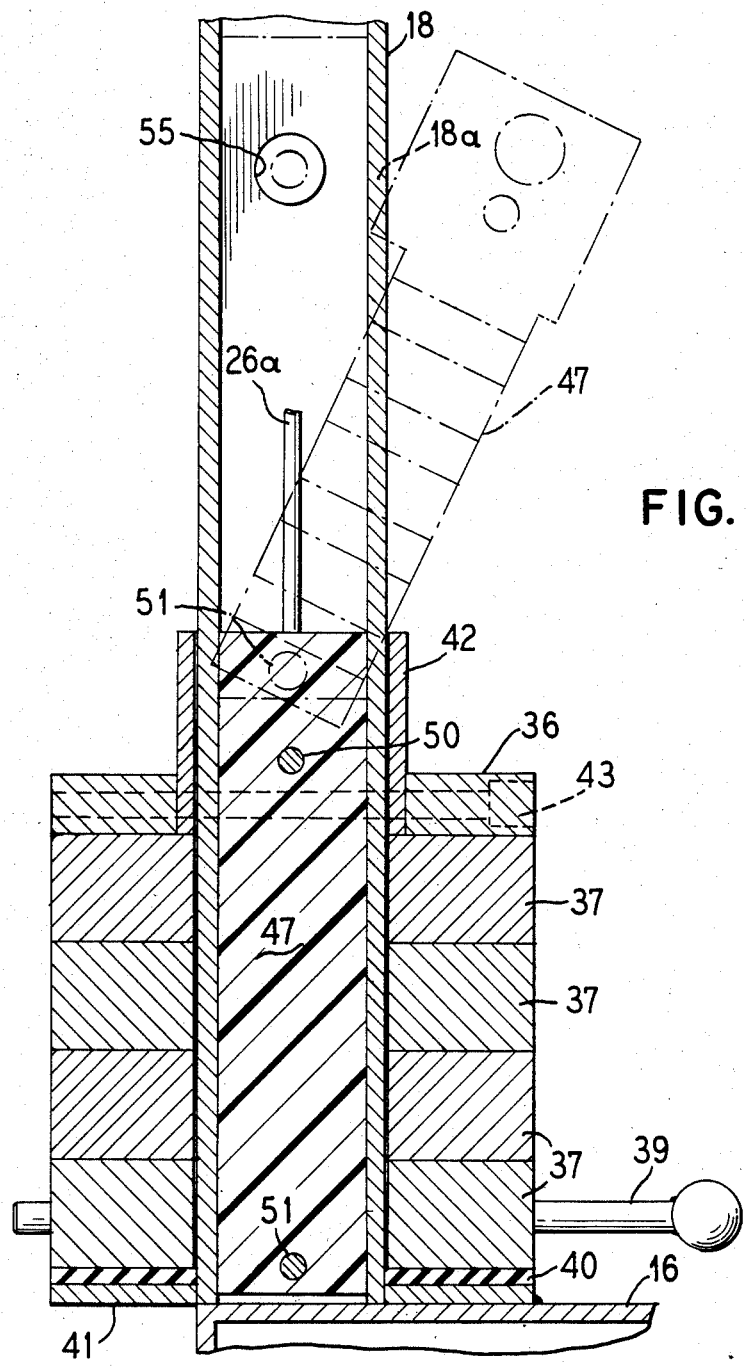
FIG. 6 is a vertical cross-sectional view taken along line VI—VI of FIG. 4.

Preferably the weights 36, 37 are placed on the column 18 before the final assembly of the upper pulley structure therewith. However, there is an easy access to reach the elongated rigid plastic portions 48, 49 and the knot 46. With the weights in the position shown in FIG. 5, the screw 43 is first withdrawn, thereby disconnecting the plug 34 from the weights 36, 37. The plug 34 can now be raised to place the upper screw 50 in alignment with an access aperture 55 (FIG. 1) where the same can be withdrawn. At this point, the central metal portion 47 can be tilted out through the slot 18*a* as shown in FIG. 6, pivoting taking place about the lower screw 51. Complete removal can be effected by placing the screw 51 in registry with the access aperture 55, installation being carried out in the reverse sequence.

The elongated rigid plastic portions 48, 49 comprise a material that has natural lubricity, such as tetrafluroethylene, and they and the cushion 40 in operation serve to keep moving metallic parts out of contact with any stationary metallic part, thus enabling relatively quiet operation of the apparatus.

A modified form of weight guide 60 is shown in FIGS. 7 and 8. Within each hollow column 18 or 19, the lower end of a cable 57 extends to an elongated plug 75 which is one of the weights. FIG. 7 illustrates the position of that weight or plug 75 when the table is not at the neutral position. This embodiment is assembled by fitting the end of the cable 57 into a ferrule 77 which is fixedly secured thereto. Either before or after this step, the cable is also threaded through an uppermost aperture 78 in a connector or yoke 79, the yoke being best shown in FIG. 8. The end of the yoke 79 nearer the viewer in FIG. 8 is then passed through the slot means 19*a*, 19*a* above the elongated plug 75 and lowered so that the ferrule 77 fits into a cavity 80 in the plug 75, and the upper horizontal portion of the yoke 79 fits into a slot 81. At this point, an aperture 82 at each side is in registration with a threaded aperture 83 in the plug 75 and a pair of mounting screws (not shown) are inserted. Thus, the vertical portions of the yoke 79 project outwardly through the slot means 19*a*. At this point, a flat uppermost weight 84 is fitted over the outside of the vertical column 19 and is lowered onto the yoke 79. A central opening 85 as clearnace with respect to the column 19 and the opening 85 is notched at its front and rear edges so that the vertical portions of the yoke 79 can pass therethrough. The lower side of the weight 84 has a groove 86 that extends forwardly and which receives a forward portion 87 of the yoke 79 and the rear portion of the weight 84 at its lower side has a transverse groove 88 which receives a transverse lower portion 89 of the yoke 79. When these parts are so interfitted, then apertures in the lower portions 87, 89 are in registration with corresponding apertures of the weight 84 to receive a fastening means. Thus the weight plug 75 within the column 19 is rigidly connected to the external weight 84 for joint movement. The assembly of the movable parts of FIG. 8 thus constitute the minimum weight mass and hence the source of the minimum resistance that the resistance means can provide.

There are two means by which this minimum mass can be increased. As shown in FIG. 7, the plug 75 extends for a distance below the lower surface of the weight 84 and is provided a series of apertures which register with the vertical slot means 19*a*. In surrounding relation to the vertical column 18 or 19, there is disposed a further set of weights 90–93, each of which has a transverse aperture which registers with the slot means 18*a*. When the table is in the neutral position, all the weights 84, 90–93 will be in the lowermost position, with the apertures in the weights 90–93 in registration with the apertures in the plug 75 . A connector pin 94 may be selectively inserted through the vertical slot means 19*a* and any one of the sets of aligned apertures. Since these are all located below the weight 84, depending upon which aperture is selected, from one to all of the additional weights may be coupled to the weight 84. Then when the table is rotated from the neutral position, the weights 75, 84 and 90 move up, the connector pin 94 having been inserted in the uppermost weight 90 as illustrated in FIG. 7. A cushion 95 is provided below the lowermost weight 93. The weights 90–93 are made symetrical and have clearance with respect to the column 18 or 19. While the weight plug 75 also has a clearance, if desired, the respective clearances can be so made that only the plugs 75 of e pendulous mass could possibly engage the column 19, and if desired, means may be provided for minimizing sliding friction, thereby providing an accurate selection of weight mass.

A second form of supplemental weight means is shown at 96. The weights 96 are U-shaped. One such weight 96 is shown in place in FIG. 7 above the weight or plate 84. Each of the weights 96 has the same extent to the left, to the right, and to the rear as the weight 84. However, a slot 97 enables it to receive the vertical standard 17 and the column 18, 19. To compensate for the loss of mass that such slot provides, a suitable amount of mass is removed from the opposite side so the center of gravity is still athe center of its aperture. The central aperture of each weight 96 has the same configuration as the aperture 85 of the weight plate 84. The upper end of the yoke 79, also referred to herein as a connector, projects forwardly through the slot 19*a*. Thus the profile of the column 19 taken with the connector 79 corresponds to the profile of the aperture 85 shown in FIG. 8. This then is also the profile of the aperture in the auxiliary weights 96. Thus they also receive in opposite slots the projecting portions of the connector or yoke 79. This arrangement provides precision relative location so that the registration of the center of gravity of the weight 96 is properly placed.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A weight guide for an exercising machine, comprising:

(a) a base having a hollow vertical column;

(b) a cable having one end extending downwardly into said hollow vertical column, and adapted at its other end to be tensioned and released by the user of the exercising machine;

(c) an elongated plug disposed in said hollow column and connected to said one end of said cable, said plug having a plurality of horizontal apertures;

(d) a number of individual weights embracing said hollow column and each a horizontal aperture;

(e) a connector joining a selected one of said weights to said elongated plug extending through an aligned pair of their apertures and through an aligned pair of vertical slots in said column; and (f) said elongated plug comprising:

(1) a metal central portion having the apertures receptive of said connector; and (2) a pair of elongated rigid plastic portions disposed at opposite sides of and secured to said central portion for engaging the interior of said hollow vertical column while holding said central metal portion out of engagement therewith.

2. A weight guide according to claim 1, said elongated plug comprising:

(a) a metal central portion having the apertures receptive of said connector; and (b) a pair of elongated rigid plastic portions disposed at opposite sides of and secured to said central portion for engaging the interior of said hollow vertical column while holding said central metal, portion out of engagement therewith.

3. A weight guide according to claim 1, said rigid plastic portions being of a material that has a natural lubricity.

4. A weight guide according to claim 3, said material comprising tetrafluoroethylthene.

5. A weight guide for exercising machine, comprising:

(a) a base having a hollow vertical column;

(b) a cable having one end extending downwardly into said hollow vertical column, and adapted at its other end to be tensioned and released by the user of the exercising machine;

(c) an elongated plug disposed in said hollow column and connected to said one end of said cable, said plug having a plurality of horizontal apertures;

(d) a number of individual weights embracing said hollow column and each having a horizontal aperture;

(e) a connector joining a selected one of said weights to said elongated plug by extending through an aligned pair of their apertures and through an aligned pair of vertical slots in said column; and (f) one of said weights being an uppermost weight having detachable means extending through said vertical column and securing said uppermost weight to said plug, said plug engaging the interior of the column, wherein said plug and said detachable means act to hold said uppermost weight out of contact with said vertical column.

6. A weight guide according to claim 5, said detachable securing means comprising a yoke secured to the upper end of said plug, said cable extending through a vertical aperture in said yoke and retained thereon by a ferrule.

7. A weight guide according to claim 5, said securing means comprising:

(a) a tubular guide extending into said uppermost weight and surrounding said vertical column in spaced relation thereto; and (b) a screw extending horizontally into said uppermost weight, an intermediate portion of said screw extending through said tubular guide and said plug.

8. A weight guide according to claim 7, said plug having a pair of vertical bosses at its upper end, one of said bosses projecting through a slot in said tubular guide and through one of said slots in said vertical column, and the other of said bosses extending to the interior surface of said tubular guide.

9. A weight guide according to claim 8, said screw extending through said bosses.

10. A weight guide according to claim 5, said cable extending through a vertical aperture in said plug to a transverse aperture in said plug, and retained thereon by a knot in said one end of said cable in said transverse aperture.

11. A weight guide according to claim 10, including an upper and a lower screw extending horizontally through said plug portions, said central portion upon removal of said upper screw being tiltable through one of said slots in said column for obtaining access to said one end of said cable.

12. A weight guide according to claim 11, said upper and lower screws having a threaded intermediate portion engaging threads in said central plug portion, and having cylindrical ends respectively received in said rigid plastic portions.

13. A weight guide according to claim 5, including means on adjacent ones of said weights for aligning said weights in spaced relation to the outer surface of said vertical column.

14. A weight guide according to claim 13, each of said weights having a pair of centering pins extending downwardly and an upwardly directed pair of guide holes opening upwardly toward said weight thereabove and receptive of pairs of said pins respectively.

15. An exercising machine employing weights, comprising:

(a) a base including a pair of hollow vertical columns forming a part thereof;

(b) a pair of support tables rotatably carried on said base, and each adapted to support a single human foot, respectively;

(c) a vertical standard supported on said base and having means at its upper end for transmitting a reactive force to the human body, said standard being disposed at a common lateral side of said support ta bles; and (d) a pair of resistance means having weight-guiding means supported on said base and respectively independently connected to said support tables for providing a rotary reactive force to support table rotation as each table is moved in either direction out of a neutral position, each said resistance means comprising, (1) a cable secured at one end to one of said support tables, and engageable with an outer periphery thereof as said one support table is moved out of the neutral position, said cable extending therefrom horizontally, (2) a first pulley on said base directing said cable from the horizontal to the vertical direction, (3) a second pulley disposed thereabove on said base reversing the vertical direction of said cable, said second pulley being disposed at the upper end of one of said hollow vertical columns, and directing said cable downwardly therein, (4) weight means secured to the other end of said cable, said weight means including an elongated plug assembly disposed in said hollow column and connected to said other end of said cable, said plug having a plurality of horizontal apertures, said weight means further including a number of individual weights embracing said one hollow column, and each having a horizontal aperture, (5) a connector joining one individual weight by extending through an aligned pair of their apertures to said elongated plug assembly, and through an aligned pair of vertical slots in said hollow column, and (6) said elongated plug assembly including an apertured metal central portion receptive of said connector, and a pair of elongated rigid plastic portions secured to said central portion for engaging the interior of said one hollow vertical column while holding said metal central portion out of engagement therewith.

16. An exercising machine according to claim 15, said rigid plastic portions being of material that has a natural lubricity.

* * * * *